US008127710B2

(12) United States Patent
Froehlich et al.

(10) Patent No.: US 8,127,710 B2
(45) Date of Patent: Mar. 6, 2012

(54) ARRANGEMENT FOR THE COATING OF WORKPIECES

(75) Inventors: Gerhard Froehlich, Schoeffengrund (DE); Gunter Boerner, Sinsheim/Eschelbach (DE); Thomas Kroll, Butzbach (DE); John Winter, Butzbach (DE)

(73) Assignee: ABB AG, Mannheim (DE)

( * ) Notice: Subject to any disclaimer, the term of this patent is extended or adjusted under 35 U.S.C. 154(b) by 360 days.

(21) Appl. No.: 12/394,181

(22) Filed: Feb. 27, 2009

(65) Prior Publication Data

US 2009/0217869 A1 Sep. 3, 2009

(30) Foreign Application Priority Data

Feb. 29, 2008 (DE) ..... 10 2008 011 998

(51) Int. Cl.

| | |
|---|---|
| ***B05B 13/02*** | (2006.01) |
| ***B05B 3/00*** | (2006.01) |
| ***B05B 1/28*** | (2006.01) |
| ***B05B 15/04*** | (2006.01) |
| ***B05B 15/12*** | (2006.01) |
| ***B05C 5/00*** | (2006.01) |

(52) U.S. Cl. ..... 118/323; 118/305; 118/326

(58) Field of Classification Search ..... 118/305, 118/323, 326

See application file for complete search history.

(56) References Cited

U.S. PATENT DOCUMENTS

| | | | | |
|---|---|---|---|---|
| 2,761,373 | A | 9/1956 | Owen | |
| 2,777,782 | A | 1/1957 | Sheffer et al. | |
| 2,810,336 | A | 10/1957 | Sheffer et al. | |
| 5,037,672 | A * | 8/1991 | Daussan et al. | 427/236 |
| 5,160,040 | A | 11/1992 | Odawara et al. | |
| 5,228,621 | A | 7/1993 | Wilson et al. | |
| 2003/0017276 | A1 * | 1/2003 | Yamada et al. | 427/421 |
| 2007/0169691 | A1 | 7/2007 | Rodrigues et al. | |

FOREIGN PATENT DOCUMENTS

| | | | |
|---|---|---|---|
| DE | 143560 | A1 | 9/1980 |
| DE | 3737455 | A1 | 5/1988 |
| DE | 9418619 | U1 | 3/1995 |
| DE | 102005032124 | A1 | 1/2007 |
| EP | 0341134 | A1 | 11/1989 |

(Continued)

OTHER PUBLICATIONS

European Patent Office; European Search Report in European Patent Application No. EP 09 00 1280 (Jun. 4, 2009).

*Primary Examiner* — Dah-Wei Yuan
*Assistant Examiner* — Binu Thomas
(74) *Attorney, Agent, or Firm* — Leydig, Voit & Mayer, Ltd.

(57) ABSTRACT

An arrangement for coating a workpiece with a working surface comprises a movement rail and a lacquering robot. The movement rail is moveable relative to a stationary reference point parallel to the working surface. The lacquering robot is disposed on the movement rail and is moveable on the movement rail. A lacquering cabin for coating a workpiece comprises at least two chassis parallel to one another and a lacquering apparatus with an opening. The lacquering apparatus is supported on the two chassis and is moveable with the chassis. A method for coating a workpiece using a lacquering cabin comprises subdividing the workpiece into adjacent sections, moving the lacquering cabin to a position corresponding to a section, and coating the section.

4 Claims, 2 Drawing Sheets

FOREIGN PATENT DOCUMENTS

| | | | | |
|---|---|---|---|---|
| EP | 0369484 | A1 | | 5/1990 |
| EP | 455371 | A2 | | 11/1991 |
| EP | 1506819 | A2 | | 2/2005 |
| GB | 678271 | A | | 9/1952 |
| GB | 683469 | A | | 11/1952 |
| GB | 706600 | | * | 3/1954 |
| GB | 706600 | A | | 3/1954 |
| GB | 2180173 | A | | 3/1987 |
| JP | 04063163 | A | | 2/1992 |

* cited by examiner

101

102

ARRANGEMENT FOR THE COATING OF WORKPIECES

Priority is claimed to German Patent Application No. DE 10 2008 011 998.9, filed on Feb. 29, 2008, the entire disclosure of which is incorporated by reference herein.

The invention relates to an arrangement for coating a workpiece having at least one lacquering robot, which is arranged on a movement rail and can be moved thereon along a movement direction. Furthermore, the invention also relates to a lacquering cabin for coating a workpiece, having at least one lacquering apparatus, having two mutually opposite openings between which a working area is provided, and to a method for the coating of a workpiece in a lacquering cabin such as this, with the workpiece being longer than the working area which is bounded by the lacquering cabin.

BACKGROUND

It is generally known that so-called lacquering apparatuses are used for the coating of workpieces, in particular with paint or lacquers. Suitable lacquering apparatuses are, for example, lacquering robots which are provided with a lacquer atomizer. Furthermore, for example, a plurality of lacquering atomizers, which are arranged in the form of an opening such that they cannot move with respect to one another and through which opening an object to be lacquered can be moved may, for example, also be regarded as a lacquering apparatus.

A lacquering robot guides the lacquering atomizer during the coating process in accordance with the program along a predetermined movement path at a predetermined speed around the workpiece to be coated, with respective atomizer parameters normally being preset for the various sections of the movement path, for the lacquering atomizer.

A lacquering robot normally has six degrees of freedom of movement and its working area is restricted to an area of 2 m to 3 m around its base. By way of example, a robot such as this can be used to lacquer relatively small workpieces such as bumper bars for automobile bodyworks, without any relative movement of the robot base with respect to the workpiece.

In order to lacquer larger workpieces, such as automobile bodyworks, it is normal practice to provide a robot such as this with a seventh degree of freedom of movement by mounting it on a movement rail associated with it, in which case all seven degrees of freedom of movement are generally taken into account completely for control of the robot. A robot such as this can now be moved along the object to be lacquered, along the movement rail of the robot, which in the automobile field typically has a length of 4 m to 10 m.

Particularly in the case of elongated workpieces, this results in a corresponding length of the movement rail of a robot or of a lacquering apparatus.

SUMMARY OF THE INVENTION

For the coating of elongated workpieces, such as rotor blades of wind power installations, the movement of the very long workpiece during the coating process should as far as possible be avoided in order to reliably avoid lacquering errors which would otherwise occur. This is because, during the manufacturing process, the rotor blade is generally attached in the horizontal position to the rotor flange at one end, such that any movement of the rotor blade causes it to oscillate, for example with an amplitude of more than ±250 mm at its free end that is not clamped in, thus making a coating process virtually impossible.

The disadvantages of a long length of a movement rail of a lacquering apparatus of, for example, 40 m are not only the large amount of technical complexity to design a correspondingly long lacquering cabin with a movement rail but also the complexity resulting from the length of the cabin, for its ventilation. With a generally normal air sink rate of 0.3 m/s and a lacquering cabling in cabin footprint of 50 m×6 m, this results, for example, in a requirement of above 320000 $m^2$ of air per hour which, furthermore, must also be filtered and conditioned.

An aspect of the present invention is to specify an arrangement of the type mentioned initially which allows even elongated workpieces to be coated in as simple a manner as possible, without any loss of quality.

A further or alternate aspect of the invention is to provide a lacquering cabin and a corresponding coating method for this purpose.

The present invention provides an arrangement for the coating of workpieces having at least one lacquering robot, which is arranged on a movement rail and can be moved thereon along a movement direction. The movement rail can itself be moved relative to a stationary reference point, parallel to a working surface.

A length of the movable movement rail of 5 m to 10 m is therefore completely sufficient even for very long workpieces to be lacquered, for example with a length of 20 m to more than 70 m. At the same time, the lacquering robot has very good accessibility along the movement rail to a workpiece which is located parallel to the movement rail, such that this workpiece can be coated completely.

As a result of the capability provided according to the invention for movement of the movement rail itself, this, together with the lacquering apparatus, can assume different working positions with respect to the workpiece to be coated such that workpieces of any desired length which, for example, is considerably greater than the length of the movement rail, can be coated.

This advantageously makes it possible to drastically reduce the large amount of manufacturing effort which has been incurred until now for coating using a stationary movement rail, while at the same time considerably improving the manufacturing quality.

According to one preferred refinement of the arrangement according to the invention, the movement rail is connected to at least one chassis which allows a uniform movement of the movement rail. This modular design of the arrangement advantageously considerably reduces the design complexity for implementation of the movement capability of the movement rail.

According to a further variant of the arrangement according to the invention, this chassis has at least two shafts, which are arranged parallel to one another and are each provided with at least one wheel which is guided in or on rails. The use of wheels allows the chassis to be moved with particularly little friction. The use of a rail to guide the wheels of the chassis predetermines the movement path of the movement rail itself, which preferably itself runs parallel to the movement path of the lacquering robot on the movement rail.

This advantageously makes it possible to compensate for the restriction in the freedom of movement of the lacquering robot resulting from a shorter movement rail, by simple movement of the movement rail itself in the same direction.

According to a further particularly preferred refinement of the arrangement, movement rails are arranged parallel to one another and are rigidly coupled to one another with a fixed distance between them.

The movement rails are preferably rigidly coupled such that the coupling means, for example a lateral support, will not collide with any support for the workpiece when the working position of the apparatus changes, for example a support which supports the load of the workpiece from underneath.

Furthermore, rigid coupling of the movement rails reduces the complexity for moving the arrangement to a different working position.

When two preferably opposite movement rails, on each of which lacquering apparatuses are arranged such that they can move, are arranged parallel, this allows a workpiece to be lacquered on both sides.

According to one alternative embodiment, a chassis which supports the movement rail can be moved by means of a drive. This further simplifies a change in the working position of an arrangement according to the invention.

The further aspect relating to a lacquering cabin for the coating of workpieces having at least one lacquering apparatus, having two mutually opposite porchway-like openings, between which a working area is provided is achieved according to the invention in that the lacquering cabin is supported on at least two chassis, which are arranged parallel to one another, and can be moved together with them.

A lacquering cabin according to the invention is in general provided with a protective wall and possibly with a cover, which completely surrounds the lacquering apparatus and its working area.

This protective wall is preferably provided on both of its end surfaces with a respective porchway-like opening which allows a workpiece to be introduced into the working area which is bounded by the lacquering cabin, and allows elongated components, whose physical length is greater than the length of the lacquering cabin, to be processed in segments in the working area.

The lacquering cabin according to the invention therefore makes it possible to use a method which allows the coating of a workpiece which is to be lacquered and preferably cannot be moved for the duration of the processing, with the cross section of the porchway opening predetermining the maximum size of the workpiece which can be processed according to the invention.

Furthermore, on its underneath, the lacquering cabin is preferably open under the working area, that is to say it does not have a floor connected to the lacquering cabin in order in this way to allow the workpiece to be supported from underneath, if necessary.

Each lacquering apparatus, which itself has a working area, is suitable for use in the lacquering cabin. By way of example, this is an industrial robot with six degrees of freedom, without its own movement rail, or else a lacquering porchway as already mentioned, which can be moved along a movement rail which is located in the lacquering cabin.

The protective wall which surrounds the lacquering cabin represents protection for the surrounding area against the lacquer mist which is necessarily created during the coating process. The arrangement of the lacquering apparatus together with the lacquering cabin on two or more chassis allows the working position of the lacquering cabin to be changed easily.

A workpiece which is longer than the working area of the lacquering apparatus within the lacquering cabin, can be coated by movement of the lacquering cabin in the longitudinal direction in further working positions, in which case the length of the movement rail and therefore that of the lacquering cabin as well are advantageously shortened.

At the same time, the lacquer mist which is created during the coating process remains within the lacquering cabin, in a manner which is likewise advantageous.

According to one preferred refinement of the lacquering cabin, the lacquering apparatus is formed by at least two lacquering robots which are arranged on both sides of the working area. The lacquering robots, preferably those with six degrees of freedom of movement, have a high level of flexibility and a working area of about 2 m to 3 m around their base. An arrangement of a lacquering apparatus above an object to be lacquered, for example, on a connecting support between two movement rails which are arranged parallel, is also within the scope of the invention.

A movement rail for the lacquering robot is in this case advantageously not absolutely essential, provided that the range of its arms is sufficiently great. An arrangement of the lacquering robot on both sides around the working area allows a section of the workpiece to be coated on both sides, with the lacquering cabin in one and the same position.

According to a further embodiment of the lacquering cabin, the at least two lacquering robots which are provided can each be moved longitudinally on a movement rail which is arranged on both sides of the working area in the lacquering cabin, with these movement rails being supported on at least one chassis.

The working area of the lacquering robot within the lacquering cabin is thus extended and the number of lacquering cabin positions required in order to coat a long workpiece is advantageously reduced.

One particularly preferred refinement of the lacquering cabin is provided with an apparatus for supplying and/or carrying away air, in which an air filter can preferably also be arranged.

The lacquer mist which is created during the coating process can in this way be sucked out of the lacquering cabin, thus making it possible to improve the quality of the lacquering result.

The lacquering cabin is preferably operated in reduced pressure, that is to say more air is sucked out in the bottom area of the lacquering cabin than flows in through the top of the cabin. The amount of air that is missing is sucked in from the surrounding area through the opposite porchway-like openings. This advantageously reduces the lacquer mist that is emitted to the surrounding area.

According to a further preferred embodiment, containers for liquid media, for example supply container and/or reservoirs for lacquer and/or solvent, which can move with the lacquering cabin, are arranged thereon such that there is no need for complex supply lines for the various liquids.

This results in a movement path of 50 m or more for the lacquering cabin, depending on the length of the workpiece to be coated. Arrangement of the media containers on the lacquering cabin avoids a correspondingly long media line, for example for lacquer, from the movable lacquering cabin to a stationary lacquer supply, for example by means of a lacquer line.

This advantageously reduces the design complexity for media supply and disposal. Furthermore, the considerably reduced hose length between the lacquer supply and the lacquering apparatus results, for example, in a better switch-on response of the lacquer atomizer, and thus in a higher quality lacquering result.

According to a further aspect, the present invention provides a method for coating a workpiece in the lacquering cabin having the features described above, with the workpiece being longer than the working area that is bounded by the lacquering cabin. The workpiece is coated sequentially, with the workpiece being subdivided into a plurality of axially mutually adjacent sections.

In this case, in order to coat one respective section, the lacquering cabin is moved to a position in which the section of the workpiece that is intended to be coated is arranged in the working area and is thus surrounded by the lacquering cabin and can be coated by means of the lacquering apparatus.

This method also makes it possible to coat workpieces which are longer than the working area of the lacquering apparatus, within the lacquering cabin.

The lacquering cabin and the workpiece are advantageously fixed with respect to one another during the process of coating one section. Mutual movement, for example as a result of an acceleration or braking movement of a lacquering robot on its movement rail that is rigidly connected to the lacquering cabin, is thus precluded, and the lacquering result is improved.

In a further refinement of the method according to the invention, any desired number of sections to be coated and any desired number of mutually adjacent positions of the lacquering cabin are provided, with the lacquering cabin being moved virtually continuously during the process of coating a plurality of sections.

The instantaneous relative position of the lacquering cabin with respect to the workpiece is the reference for the movement of the lacquering apparatus. In this case, the lacquering apparatus should very largely avoid movement according to the program on the movement rail, resulting in dynamic forces on the lacquering cabin in its movement direction.

In one preferred variant of the method according to the invention, the movement of the lacquering cabin according to the program is predetermined by a robot control system.

For example, when using a lacquering robot with a movement rail and a total of seven degrees of freedom of movement, the movement of the lacquering cabin can be regarded as an eighth degree of freedom of movement, with corresponding movements being predetermined in the same way as the seven other degrees of freedom of movement by one and the same robot control system.

When using a lacquering robot with six degrees of freedom and without a movement rail, the movement of the lacquering cabin is controlled in the same way as a movement of the lacquering robot on a movement rail.

The movement is advantageously controlled by a robot control system that is already provided and thus controls and coordinates all the movements of the lacquering robot and lacquering cabin.

In a further refinement of the method, the movement of the lacquering cabin is determined on the basis of the surface to be lacquered of the workpiece in the respective section. The smaller the area per length of a section of the workpiece to be lacquered is, the more quickly a further working position is moved to.

The lacquering time for a workpiece can therefore advantageously be reduced.

Further refinement aspects can be found in the claims.

BRIEF DESCRIPTION OF THE DRAWINGS

The invention, advantageous embodiments and further advantages will be described and explained in more detail with reference to exemplary embodiments which are illustrated in the figures, in which.

DETAILED DESCRIPTION

Figure 1:
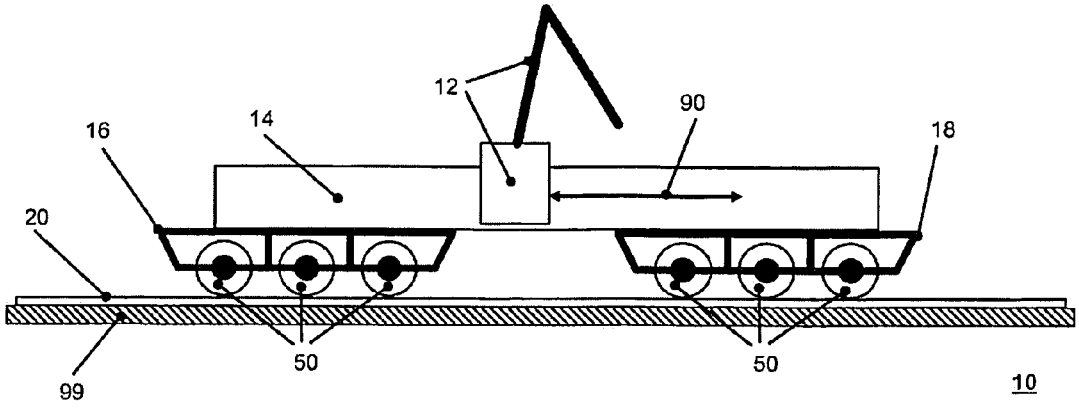
FIG. 1 shows a first exemplary arrangement of a lacquering robot on a moving movement rail.
Figure 2:
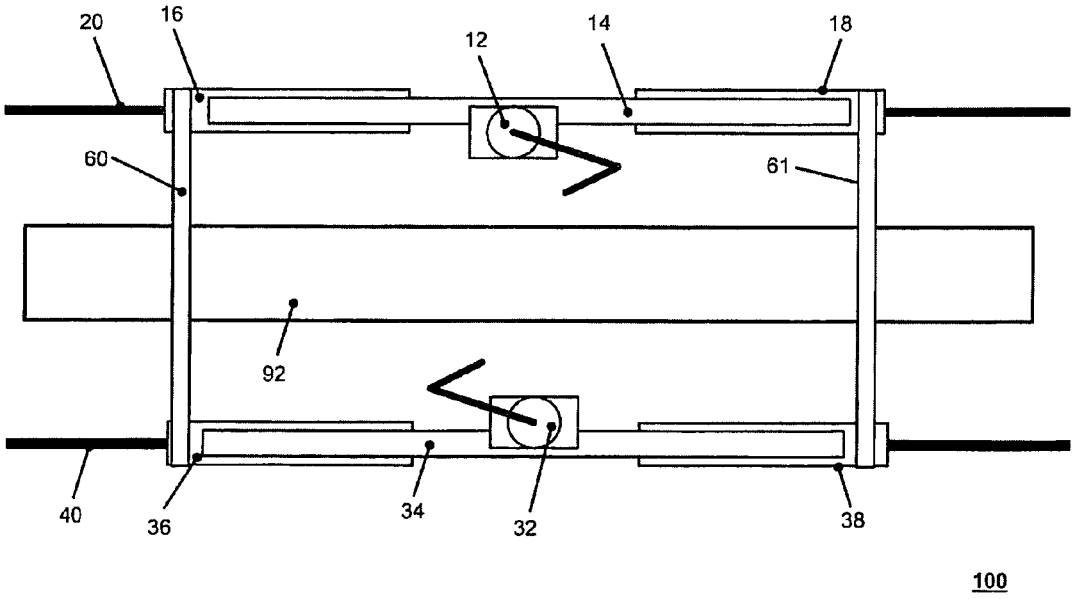
FIG. 2 shows a plan view of an exemplary arrangement of two lacquering robots on two coupled movement rails.

FIG. 1 shows an exemplary arrangement 10 of a lacquering robot 12 on a moving movement rail 14. This arrangement can be regarded as a part of a further arrangement, which is shown in FIG. 2 and which represents two movement rails which are arranged parallel and are connected to one another. The lacquering robot 12 preferably has seven degrees of freedom of movement including the movement rail, which is also referred to as a seventh axis. An arrow indicates the two movement directions 90 along which the lacquering robot 12 can be moved on the movement rail 14, corresponding to the preset by the processing program, which determines the movement path of a lacquer atomizer, which is not shown but is connected to the lacquering robot 12. The movement rail 14 is a standard movement rail for lacquering robots, which is generally offered by the same manufacturer as the associated lacquering robot.

At each of its two ends, the movement rail 14 is connected to a first chassis 16 and a second chassis 18. The chassis 16, 18 as a basic structure, preferably have supports composed of a suitable material, for example steel, which is indicated as a bar in FIG. 1. Each chassis in the illustrated example has three shafts, to which wheels 50 are in each case connected. In the illustrated example, one wheel per shaft can in each case be seen, which is in each case guided on a rail 20 which can correspond to a commercially available railroad rail. For example, the wheels 50 can be guided on the rail 20 by suitable flanges, in a similar manner as in the case of a wheel of a railroad wagon. The rail 20 is connected to a working surface 99, for example a concrete building floor. For the situation in which the arrangement illustrated in FIG. 1 is not—as described above—a part of the arrangement as shown in FIG. 2 of two connected movement rails, it would in each case be necessary to provide two wheels 50 per shaft and two rails 20, in order to make the apparatus sufficiently stable.

The forward and rearward movement direction of the chassis, as predetermined by the rail 20, corresponds to the two movement directions 90 of the lacquering robot on the movement rail.

FIG. 2 once again shows a plan view of an exemplary arrangement 100 of two lacquering robots 12, 32 on two coupled movement rails 14, 34. As already illustrated from a different perspective in FIG. 1, the first movement rail 14 is connected to a first chassis 16 and to a second chassis 18, and is guided by wheels, which are not shown in this illustration, on a rail 20, with these wheels also supporting the load of the arrangement on the rail 20. In an analogous structure, parallel to this, the movement rail 34 is connected to a third chassis 36 and a fourth chassis 38, which are themselves guided on wheels 50, which are not shown, on a rail 40 which runs parallel to the rail 20. The two movement rails 14, 34 are arranged parallel and separated by a distance from one another which makes it possible to arrange a workpiece 92 that is to be lacquered between them. The lacquering robots which are located on the movement rails are mutually opposite, that is to say they have a working area in the direction of the workpiece 92 to be lacquered.

The first chassis 16 and the third chassis 36 are rigidly coupled to one another via a first connecting element 60. The second 18 and the fourth 38 chassis are rigidly coupled to one another in an analogous manner via a second connecting element 61. By way of example, suitable connecting elements 60, 61 are steel supports in the form of a porchway. The porchway-like form prevents the connecting elements 60, 61 from colliding with the workpiece 92. This arrangement can be regarded as a basic structure of the lacquering cabin shown in FIG. 3.

Figure 3:
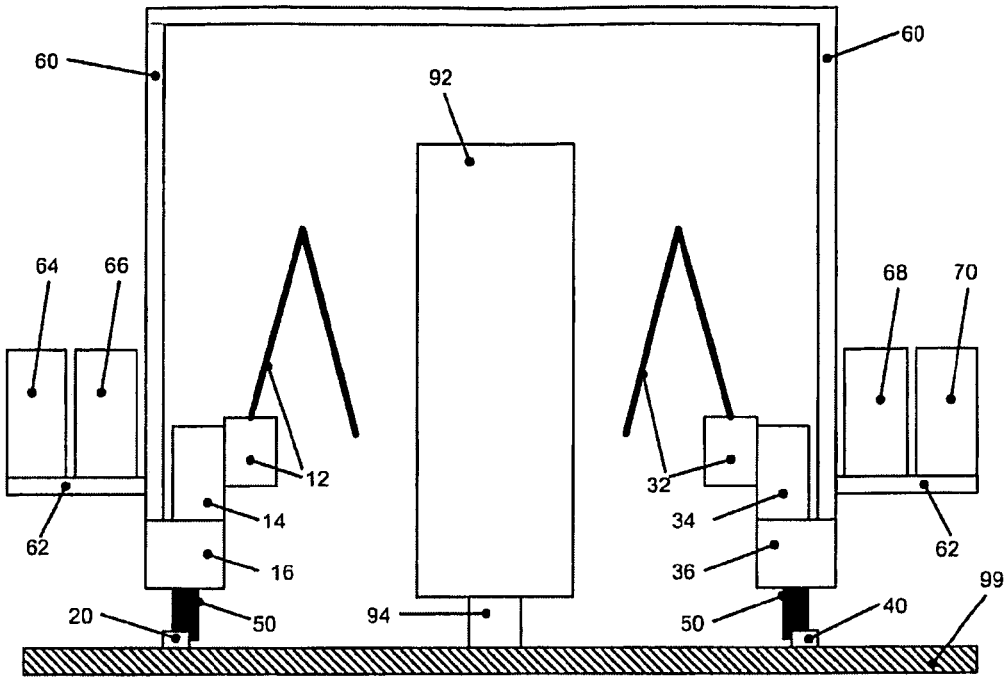
FIG. 3 shows a first front view of an exemplary lacquering cabin.

FIG. 3 shows a front view of the arrangement illustrated in FIG. 2, with additionally a horizontal stand surface 62 on each of the two sides of the lower outer area of the first connecting element 60 being illustrating. This horizontal stand surface 62 preferably runs over the entire length of the lacquering cabin and is used as a working surface and positioning surface. A first container 64, a second container 66, a third container 68 and a fourth container 70 are illustrated upright on the two stand surfaces 62. These containers are used, for example, to supply lacquer and/or solvent, or else for disposal of solvent which has been used for cleaning purposes according to the program.

The workpiece 92 to be coated is illustrated located on a holder 94. The porchway-like form of the first connecting element 60 prevents collisions with the workpiece 92 and its holder 94.

As in FIG. 2, the lacquering robots 12 and 32 are also illustrated once again, and are arranged on the movement rails 14 and 34, which are themselves located on chassis, of which the first chassis 16 and the third chassis 36 can be seen in this illustration. In the case of the wheels 50, which are guided by means of the rails 20 and 40, a running surface is illustrated which is in contact with the upper edge of the respective rail 20, 40, as well as a flange for guidance.

Figure 4:
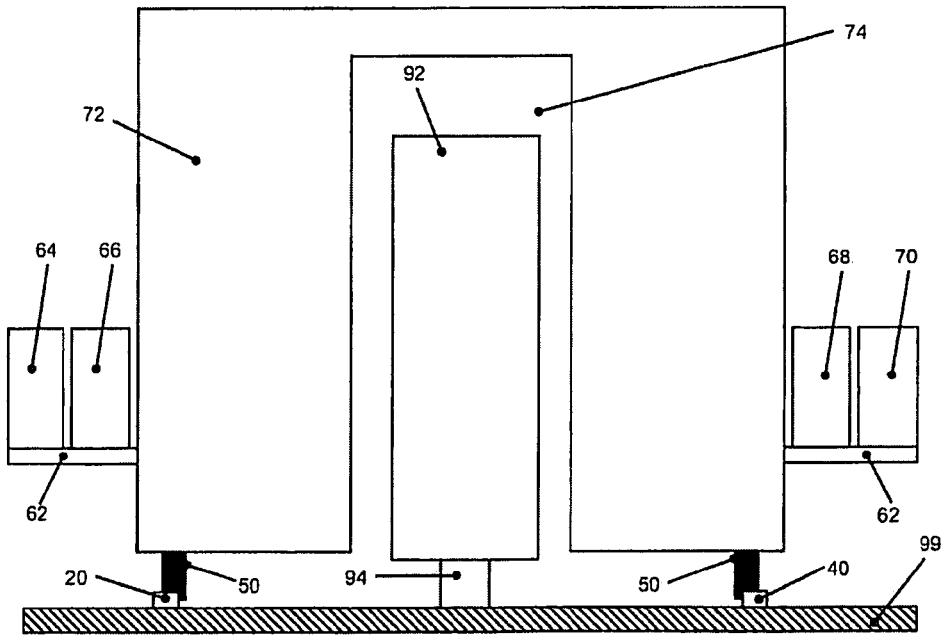
FIG. 4 shows a second front view of an exemplary lacquering cabin with an end wall.

FIG. 4 shows the same front view of an exemplary lacquering cabin as FIG. 3, but with the end face now being shown with a cabin wall 72 which has a porchway-like opening 74.

LIST OF REFERENCE SYMBOLS

10 Exemplary arrangement, lacquering robot on moving movement rail
12 First lacquering robot
14 First movement rail
16 First chassis
18 Second chassis
20 First rail
32 Second lacquering robot
34 Second movement rail
36 Third chassis
38 Fourth chassis
40 Second rail
50 Wheel
60 First connecting element
61 Second connecting element
62 Stand surface
64 First container
66 Second container
68 Third container
70 Fourth container
72 Cabin wall with porchway-like opening
74 Porchway-like opening
90 Movement directions
92 Workpiece
94 Holder
99 Working surface
100 Plan view of two coupled movement rails with robots and chassis
101 Front view of exemplary lacquering cabin
102 Front view of exemplary lacquering cabin with end wall

What is claimed is:

1. A lacquering cabin for coating a workpiece, comprising:
two opposite openings providing a working area therebetween;
at least two chassis disposed parallel to each other;
first and second movement rails, each supported on at least one of the at least two chassis and being disposed on respective sides of the working area, the movement rails being movable with respect to a stationary reference point, in a first direction; and
a lacquering apparatus including first and second lacquering robots respectively disposed on the first and second movement rails on respective sides of the working area, each of the first and second lacquering robot being movable on the respective movement rail along the first direction.

2. The lacquering cabin as recited in claim 1, further comprising an air-handling apparatus.

3. The lacquering cabin as recited in claim 2, wherein the air-handling apparatus is configured to supply, carry away, or clean air.

4. The lacquering cabin as recited in claim 1, further comprising a container for liquid media.

* * * * *